US005390764A

United States Patent [19]

Kerber

[11] Patent Number: 5,390,764

[45] Date of Patent: Feb. 21, 1995

[54] STORE CHECKOUT STAND

[75] Inventor: Philip S. Kerber, Baudette, Minn.

[73] Assignee: Services, Inc., Baudette, Minn.

[21] Appl. No.: 40,176

[22] Filed: Mar. 29, 1993

[51] Int. Cl.[6] ..... A47F 9/04

[52] U.S. Cl. ..... 186/68; 248/279; 248/287

[58] Field of Search ..... 186/59, 61, 68, 69; 248/124, 279, 287, 441.1

[56] References Cited

U.S. PATENT DOCUMENTS

| | | | |
|---|---|---|---|
| 2,418,067 | 3/1947 | Carpenter, Sr. | 248/121 X |
| 3,700,074 | 10/1972 | Shoffner . | |
| 3,730,469 | 5/1973 | Shields . | |
| 4,401,189 | 8/1983 | Majewski | 186/68 |
| 4,618,032 | 10/1986 | Woolf | 186/61 |
| 4,619,427 | 10/1986 | Leymann | 248/178 |
| 4,687,166 | 8/1987 | Poehler | 248/279 |
| 4,789,048 | 12/1988 | Cramer et al. | 186/61 |
| 4,838,383 | 6/1989 | Saito et al. | 186/59 |
| 4,953,664 | 9/1990 | Vrooman et al. | 186/61 X |
| 4,963,721 | 10/1990 | Kohno et al. | 235/462 |
| 5,019,694 | 5/1991 | Collins | 186/61 |
| 5,039,051 | 8/1991 | Umebara et al. | 248/284 |
| 5,082,037 | 1/1992 | Hammons et al. | 248/287 X |
| 5,183,135 | 2/1993 | Kurimoto et al. | 186/61 |
| 5,207,294 | 5/1993 | Kurimoto et al. | 186/61 |

*Primary Examiner*—F. J. Bartuska

*Attorney, Agent, or Firm*—Vidas, Arrett & Steinkraus

[57] ABSTRACT

A cashier's stand for three belt checkout stations is provided, the stand having a T-bar construction comprising a support channel beam and cross beam from which a keyboard stand for use by a cashier and a writing stand for use by the customer upwardly extend. The stand may be easily mounted via support channel beam and mounting brackets extending from the cross beam. A telescopic L-bracket head in combination with a pivoting podium provide ease of adjustment in addition to a secure stand for a register keyboard. A new feature in the area of store checkout stands called cable management designating the ability to cableway data through a mainframe to various places without the cable wires being exposed is also provided. The cable wires are concealed in the mainframe tubing. The present invention may also provide a conduit for a cable connection between the scanner and an LED display, which may be located at the customer stand.

43 Claims, 3 Drawing Sheets

STORE CHECKOUT STAND

BACKGROUND OF THE INVENTION

1. Field of the Invention

This invention relates generally to retail store checkout stands and more specifically to a store checkout stand with a keyboard podium for use with three belt supermarket checkout stations and the like.

2. Description of the Related Art

Prior checkout stands used with three belt checkout stations have employed separately mounted stands for the register keyboard used by the checkout person and the customer. In such assemblies, there is often a belt gap of 15"–16" between the primary belt and the two secondary belts which carry the merchandise after it is scanned. As no rail extends across the belt gap, the customer writing stand must be mounted farther away from the cashier than is convenient.

Further disadvantages of such checkout stands include the instability and unwieldiness of the keyboard stands they provide. The manner in which they are mounted, via a small mounting bracket attached to the rail by screws is unstable. The keyboard stand itself is inconvenient as adjustment thereof is difficult. The pivoting mechanism provided must be securely tightened with a wrench in two places in order to meet its function of supporting a keyboard podium. Even then, use of the keyboard causes the wing nuts to become loose from repeated pressure. Adjustment of the pivots is problematic. If both wing nuts are loosened at the same time, as is necessary to move the podium toward the cashier, the support function is compromised. Since adjustment is usually necessary for each cashier, this system is inconvenient.

SUMMARY OF THE INVENTION

The present invention provides a store checkout stand having a T-bar base which holds a cash register keyboard stand at one end of the crossbar and a customer writing stand at the other end. The checkout stand is ideal for use with three belt checkout stations. The T-bar construction comprises a support channel beam and cross beam from which a keyboard stand for use by a cashier and a writing stand for use by the customer upwardly extend.

The stand may be easily mounted via support channel beam and mounting brackets extending from the cross beam. A telescopic L-bracket head in combination with a pivoting podium provide ease of adjustment in addition to a secure stand for a register keyboard. The T-bar construction of the base and the L-bracket head of the keyboard stand provide a consistent center of gravity which provides enhanced stability to the keyboard podium despite the constant pressure on the keyboard.

The present invention further provides a new feature in the area of store checkout stands called cable management. Cable management designates the ability to cableway data through a mainframe to various places without the cable wires being exposed. The cable wires are concealed in the mainframe tubing.

The present invention also provides a conduit for a cable connection between the scanner and an LED display, which may be located at the customer stand.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
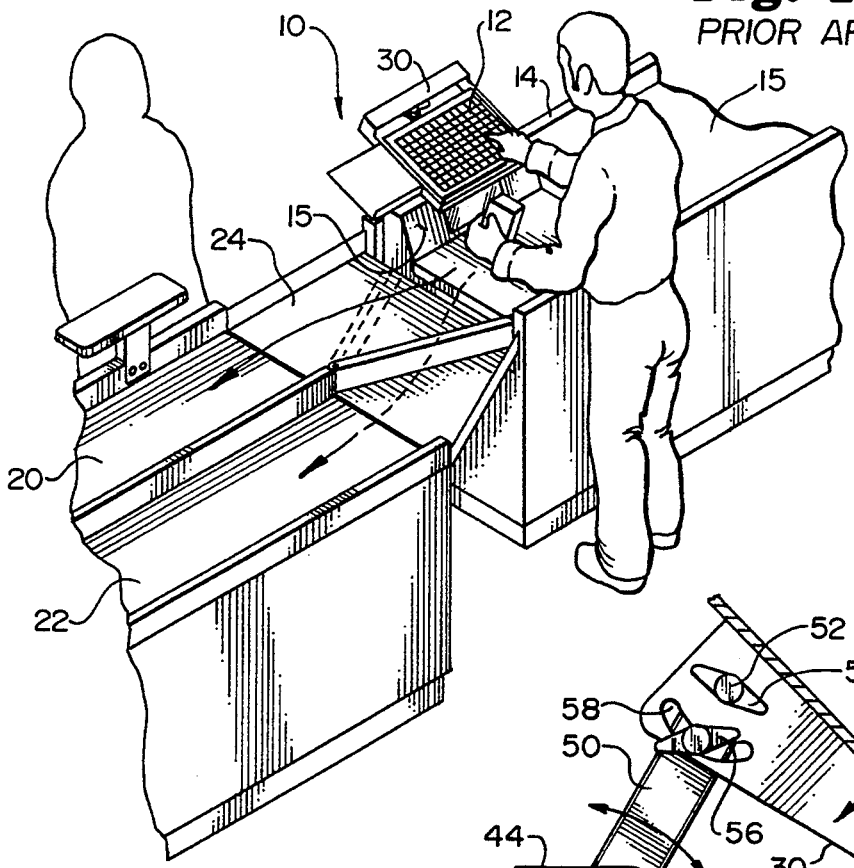
Fig. 1 PRIOR ART
FIG. 1 is a perspective view of prior art.
Figure 2:
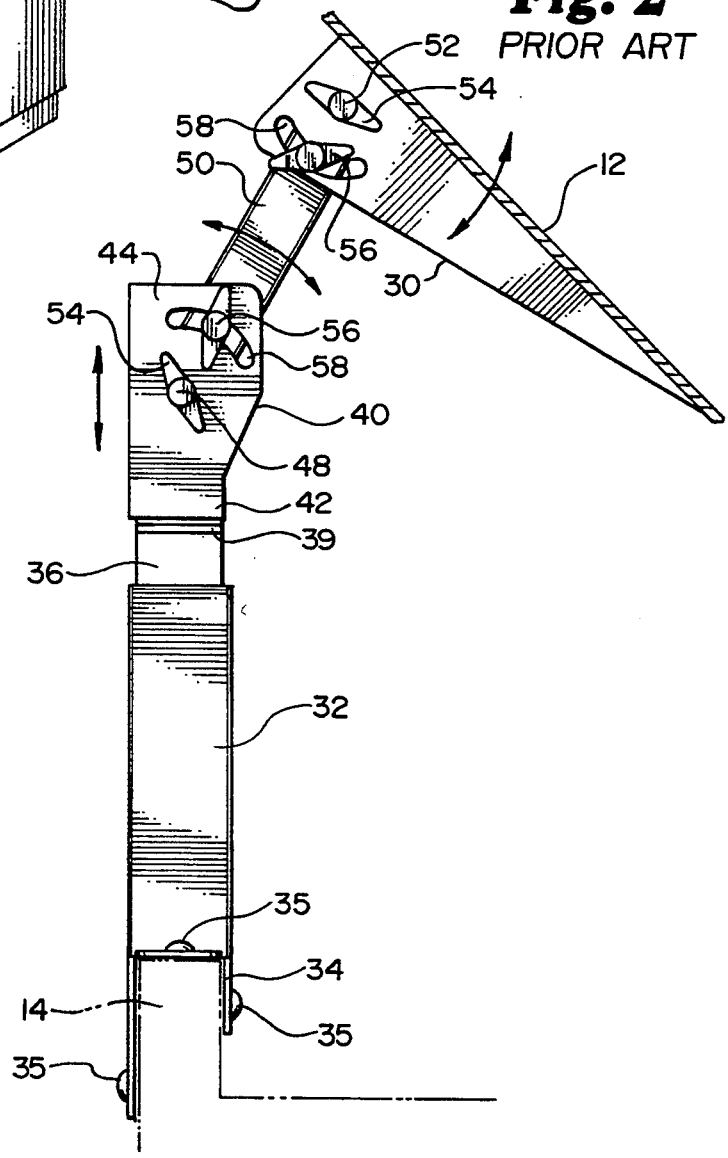
Fig. 2 PRIOR ART
FIG. 2 is a right side elevational view of the subject of the invention.

Referring to FIGS. 1 and 2, a representative prior art checkout assembly with three belts, primary belt 15 and secondary belts 20, 22, is shown generally at 10. The trend in checkout stands is to provide a cash register and keyboard situated such that the cashier is facing the customer. As is shown, register keyboard 12 is mounted on counter rail 14 above scanner 15. Customer writing stand 18 is mounted on rail 14 above secondary belt 20 beyond gate area 24 between scanner 15 and secondary belts 20 and 22. Referring to FIG. 2, the prior art register keyboard podium 30 is shown. Base upright 32 is attached to counter rail 14 by means of base bracket 34. Base bracket 34 is attached to rail 14 by means of screw bolts 35. This type of mounting has a distinct disadvantage in that it is unstable. Telescopic slide 36 has first and second ends, 38 and 39, and slidably mates with base upright 32 at its proximal end 38 (not shown). Pivot bracket head 40, having proximal and distal ends 42, 44, respectively, extends from second end 39 of telescopic slide 36.

First pivot 48, located at pivot bracket head 40, provides a pivot means for adjusting keyboard podium 30. Pivot leg 50 extends between first pivot at pivot bracket head 40 and second pivot 52 located at podium 30. Wing nuts 54,56 are provided at each end of pivot leg 50. Wing nuts 56 fit into arcuate slots 58 located on pivot bracket head 40 and podium 30, respectively, providing both a supporting and pivoting function for podium 30.

Pivots 48 and 52 have to be securely tightened with a wrench in order to meet their function of supporting podium 30. Even then, use of keyboard 12 causes the wing nuts to become loose from repeated pressure. Further, adjustment of the pivots is problematic. If both wing nuts are loosened at the same time, as is necessary to move the podium toward the cashier, the support function is compromised. Since adjustment is usually necessary for each cashier, this system is inconvenient.

The present invention, as shown in FIGS. 3–7 provides a checkout stand with a keyboard podium free of these inconveniences and disadvantages. A checkout counter with three belts, primary belt 116 and secondary belts 120, 122, which also includes the checkout stand 100 of the present invention is shown generally at 110. As is shown, register 112 is mounted on keyboard support 100 exclusive of counter rail 114. Podium 130 is located above scanner 115, as in the prior art. Customer writing stand 118 is also mounted on support 100 above gate area 124 between primary belt 116 and secondary belts 120 and 122. The store checkout stand is preferably made of steel, but may be of any material possessing sufficient strength, including other metals or suitable plastics.

Figure 4:
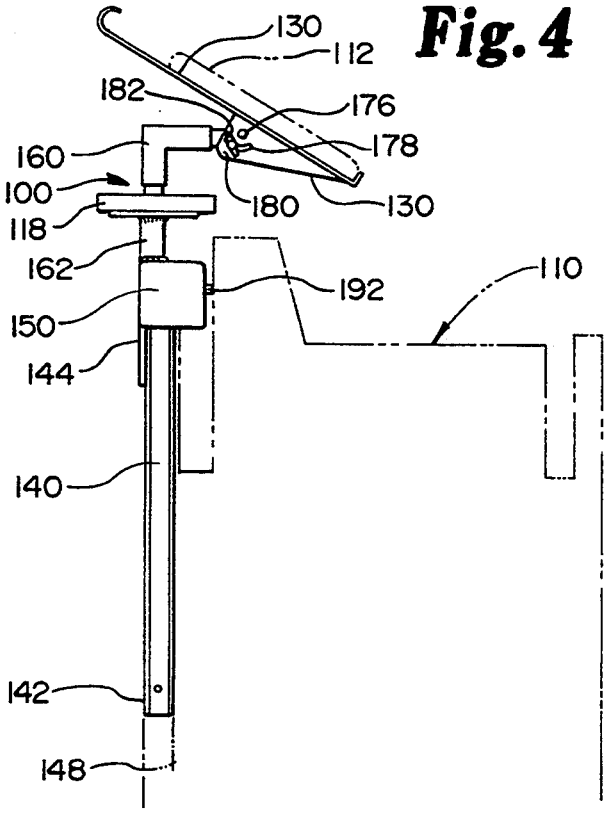
FIG. 4 is a right side elevational view thereof.
Figure 6:
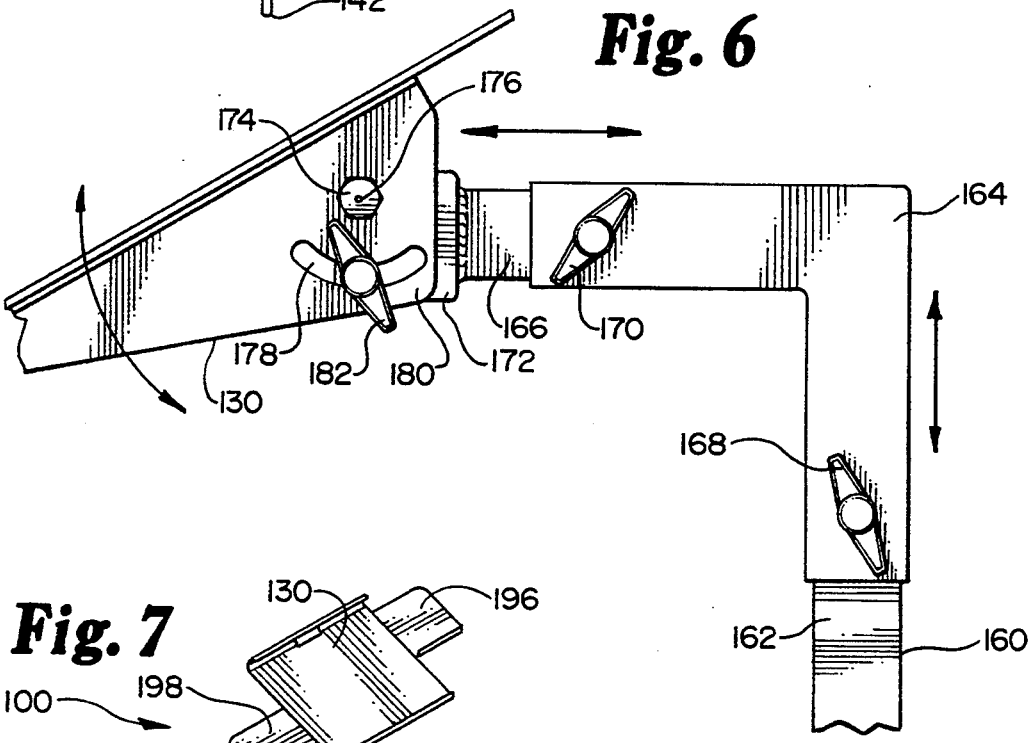
FIG. 6 is a fragmentary left side elevational view thereof.
Figure 7:
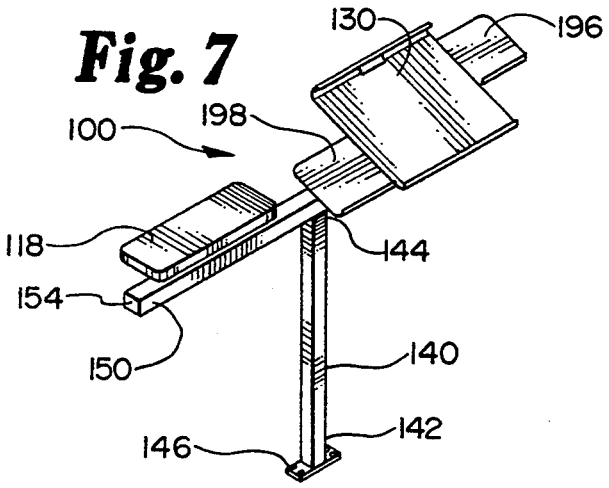
FIG. 7 is a perspective view of an alternate embodiment thereof.

Referring to FIGS. 4 and 6, support stand 100 is shown in greater detail. Support channel beam 140 has first and second ends 142, 144. Support channel beam 140 is mounted to the floor at its first end 142 by means of base 146, as shown in FIG. 7, or to cabinet base 148 of checkout counter 110, between gate area 124 and scanner 115. As shown in FIG. 4, the embodiment in which beam 140 is attached to cabinet base 148 requires no base. Beam 140 is at least about 18" in length if floor mounted, but may be shorter if mounted to counter 110.

Figure 3:
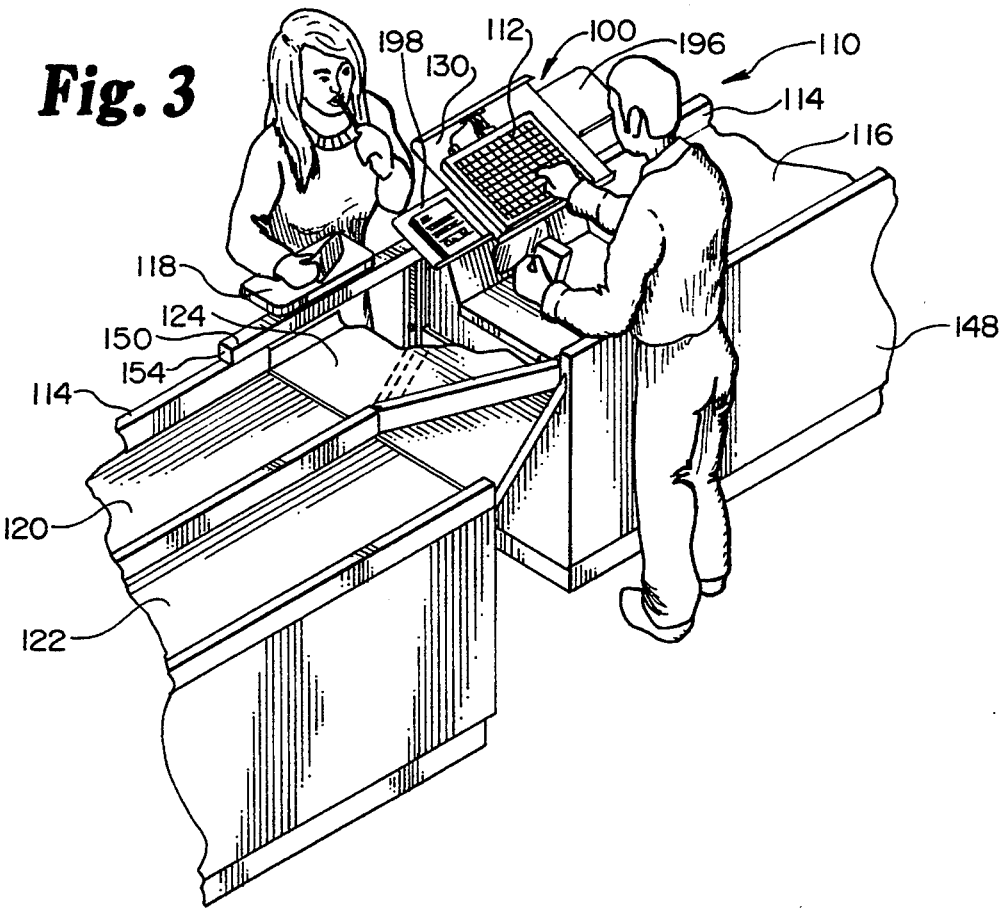
FIG. 3 is a perspective view of the subject of the invention.

Support channel beam 140 is fixed at its second end 144 to cross beam 150. Cross beam 150 has first and second ends 152, 154. Support beam 140 is nearer to first end 152, being about one third the length of cross beam 150 from first end 152, in order to provide sufficient support for podium 130. Cross beam 150 may be made of standard angle iron, or any material possessing sufficient strength. As shown in FIG. 3, cross beam 150 extends across gate area 124, first and second ends 152, 154 thereof resting on counter rail 114. First and second mounting brackets 156, 158 extend downwardly from cross beam 150 near first and second ends 152 and 154, providing a means by which cross beam 150 is secured to rail 114. Customer writing stand 118 is mounted on cross beam 150 near its second end 154.

Keyboard podium 130 is supported by keyboard stand 160, extending from cross beam 150 near its first end 152. Keyboard stand leg 162 extends from cross beam 150. L-shaped telescopic head 164 extends between stand leg 162 and podial leg 166. Screw pins 168, 170 secure telescopic head 164 to keyboard stand leg 162 and podial leg 166, respectively. Podial leg 166 is attached to podial pivot beam 172. Keyboard podium 130 is fixed to podial pivot beam 172 by means of bolt 174. Pivot point 176 is located at bolt 174. Arcuate slot 178, located on pivot flange 180 provides a pivoting and securing means in combination with screw pin 182.

Adjustment of the position of podium 130 is quite straightforward. The height may be adjusted by screw pin 168 on telescopic head 164, and moving the head along keyboard stand leg 162. The podium 130 may be brought closer to the cashier by adjusting screw pin 170 on telescopic head 164, and adjusting podial leg 166. Arcuate slot 178 and screw pin 182 on podial flange 180 may be adjusted to vary the angle of the podium.

Figure 5:
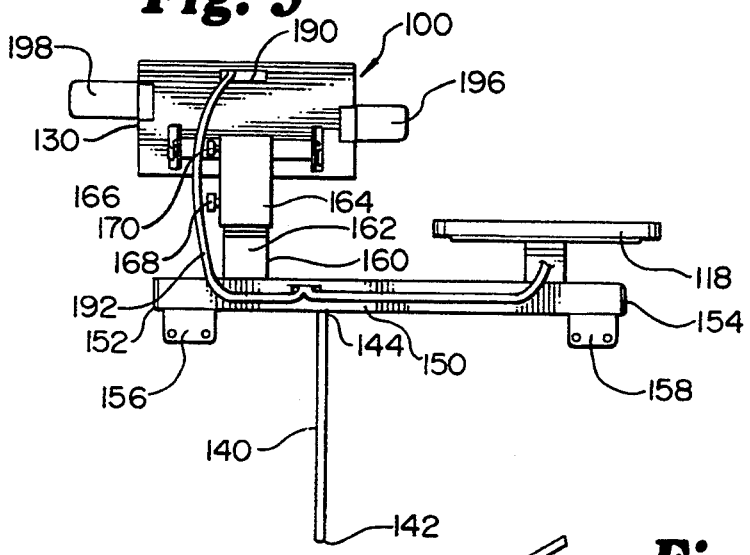
FIG. 5 is a rear elevational view thereof.

As shown in FIG. 5, wire clearance hole 190 of podium 130 provide an outlet for cable 192 which extends from register keyboard 112. Cable 192 may run along the outside of support stand 100 or may be routed through the interior of support stand 100. Auxiliary extensions 196,198 extend from podium 130, and may be used to hold additional electronic equipment, including means for verification of checks, coupons, or food stamps, in addition to LED displays, scales, or such things as papers, pens and the like.

Cross bar 150 provides a means for cable management, which enables data to be cabled through a mainframe to various places without the cable wires being exposed. The cable wires may be concealed in the mainframe tubing. Further, a conduit for a cable connection between the scanner and an LED display may be located at one of auxiliary extensions 196, 198 or at customer stand 118.

The present invention provides may advantages over prior keyboard supports. It is quite sturdy and securely holds the keyboard stand and customer stand on one frame, unlike prior supports, which do not provide a reliable pedestal for the necessary equipment. The T-bar construction of the base and the L-bracket head of the keyboard stand provide a consistent center of gravity which provides enhanced stability to the keyboard podium despite the constant pressure on the keyboard. The present invention is the first support stand of its kind which has succeeded in providing these features. The stand provides simple horizontal and vertical adjustability for changes in cashier shifts without sacrificing the stability of the keyboard and other electronic features.

The stand may be easily mounted via support channel beam and mounting brackets extending from the cross beam, or alternatively mounted to the floor by the base provided. The telescopic L-bracket head in combination with a pivoting podium provide ease of adjustment in addition to a secure stand for a register keyboard.

The capability of cable management is an additional advantage provided by the present invention, which allows data to be cabled through a mainframe to various places without the cable wires being exposed. The cable wires may thereby be concealed in the mainframe tubing. The present invention also provides a conduit for a cable connection between a scanner and an LED display, unlike prior support stands.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A store checkout stand comprising:

a) a T-shaped base comprising i) a support channel beam having first and second ends;

ii) a cross beam attached to the second end of the support channel beam, said cross beam having first and second ends:

b) a keyboard stand mounted on the cross beam of the T-shaped base proximal to the first end of said cross beam, said keyboard stand being constructed and arranged to support an independent keyboard used by a cashier; and c) a writing stand mounted on the cross beam of the T-shaped base, proximal to the second end of said cross beam, said writing stand arranged for use by a store patron and being located at a predetermined distance from the keyboard stand.

2. A store checkout stand comprising:

a) a T-shaped base comprising i) a support channel beam having first and second ends;

ii) a cross beam attached to the second end of the support channel beam, said cross beam having first and second ends; and b) a keyboard stand mounted on the cross beam of the T-shaped base proximal to the first end of said cross beam, said keyboard stand further comprising:
i) a keyboard stand leg extending upwardly from the cross beam;
ii) an angled telescopic head having
a first arm adapted to slidably mate with the keyboard stand leg so as to allow a variable telescopic extension of the first arm and the keyboard stand leg; and
a second arm angularly disposed relative to the first arm;
iii) a rectilinear keyboard podium having an upper surface, a lower surface and two side edges,
iv) a podial pivot beam attached to the lower surface of the keyboard podium;
v) a first pivot flange and a second pivot flange symmetrically located on and extending downwardly from the keyboard podium;
vi) pivot attachment means for attaching the first and second ends of the podial pivot beam to the first and second pivot flanges;
vii) a podial leg extending from the podial pivot beam and adapted to slidably mate with the second arm of the angled telescopic head so as to allow a variable telescopic extension of the second arm and the podial leg; and
viii) first securing means for securing the first arm of the angled telescopic head to the keyboard stand leg at a variable telescopic extension thereof and second securing means for securing the second arm of the angled telescopic head to the podial leg at a variable telescopic extension thereof.

3. The store checkout stand of claim 2 wherein:
a) the pivot attachment means comprises a bolt; and
b) the pivot flanges further include an arcuate slot through which a screw pin is fitted, thereby providing pivoting means for the keyboard podium.

4. The store checkout stand of claim 2 wherein the securing means are screw pin assemblies.

5. The store checkout stand of claim 2 wherein the support beam is nearer to the first end of the cross beam, such that the distance between the first end of the cross beam and the area of the cross beam which is attached to the second end of the support channel beam is about one third the length of the cross beam.

6. The store checkout stand of claim 2 wherein the keyboard podium is made of plastic.

7. The store checkout stand of claim 2 made of metal.

8. The store checkout stand of claim 2 wherein the support channel beam is at least about 18" in length and further includes a floor base located at its first end, whereby the checkout stand may be mounted to the floor.

9. The store checkout stand of claim 2 mounted to the cabinet base of a checkout counter between the gate area and the primary belt.

10. A checkout stand as in claim 2 further comprising means for cable management located in an interior portion thereof.

11. The store checkout stand of claim 2 further comprising at least one auxiliary extension extending from the keyboard podium.

12. The store checkout stand of claim 2 wherein the keyboard podium further comprises a wire clearance hole to provide an outlet for a cable extending from a keyboard supported by the keyboard podium.

13. A three belt checkout station having a base cabinet, a counter rail, a primary belt, a product scanner, first secondary belt, a second secondary belt, a gate area including a gate between the primary belt and secondary belts; and a checkout stand comprising:
a) a T-shaped base further comprising
i) a support channel beam having first and second ends;
ii) a cross beam attached to the second end of the support channel beam, said cross beam having first and second ends:
b) a keyboard stand mounted on said cross beam proximal to its first end, said keyboard stand being constructed and arranged to support an independent keyboard used by a cashier; and
c) a writing stand mounted on said cross beam proximal to its second end, said writing stand being arranged for use by a store patron and being located at a predetermined distance from the keyboard stand.

14. The store checkout station of claim 13 wherein the support beam of the checkout stand is nearer to the first end of the cross beam, such that the distance between the first end of the cross beam and the area of the cross beam which is attached to the second end of the support channel beam is about one third the length of the cross beam.

15. The store checkout station of claim 13 wherein the checkout stand is made of metal.

16. The store checkout station of claim 13 wherein the checkout stand is made of plastic.

17. The store checkout station of claim 13 wherein the support channel beam of the checkout stand is at least about 18" in length and further includes a floor base located at its first end, whereby the checkout stand may be mounted to the floor.

18. The store checkout station of claim 13 wherein the cabinet base further includes a support channel extending downwardly between the gate area and the scanner, and the support channel beam of the checkout stand is constructed and arranged to fit into said support channel, whereby the checkout stand is mounted to the cabinet base of the checkout counter.

19. The store checkout station of claim 13 wherein the writing stand of the checkout stand is mounted on the cross beam proximal to the second end thereof.

20. A three belt checkout station having a base cabinet, a counter rail, a primary belt, a product scanner, first secondary belt; a second secondary belt, a gate area including a gate between the primary belt and secondary belts; and a checkout stand comprising:
a) a T-shaped base further comprising a support channel beam having first and second ends and a cross beam attached to the second end of the support channel beam, said cross beam having first and second ends;
b) a keyboard stand mounted on said cross beam proximal to its first end, said keyboard stand further comprising:
i) a keyboard stand leg extending upwardly from the cross beam;
ii) an angled telescopic head having
a first arm adapted to slidably mate with the keyboard stand leg so as to allow a variable telescopic extension of the first arm and the keyboard stand leg, and
a second arm angularly disposed relative to the first arm:

iii) a rectilinear keyboard podium having an upper surface, a lower surface and two side edges, iv) a podial pivot beam attached to the lower surface of the keyboard podium;

v) a first pivot flange and a second pivot flange symmetrically located on and extending downwardly from the keyboard podium;

vi) pivot attachment means for attaching the first and second ends of the podial pivot beam to the first and second pivot flanges;

vii) a podial leg extending from the podial pivot beam and adapted to slidably mate with the second end of the angled telescopic head so as to allow a variable telescopic extension of the second arm and the podial leg; and viii) first securing means for securing the first arm to the keyboard stand leg at a variable telescopic extension thereof and second securing means for securing the second arm of the angled telescopic head to the podial leg at a variable telescopic extension thereof; and c) a writing stand mounted on said cross beam proximal to its second end.

21. The store checkout station of claim 20 wherein:

a) the pivot attachment means comprises a bolt; and b) the pivot flanges further include an arcuate slot through which a screw pin is fitted, thereby providing pivoting means for the keyboard podium.

22. The store checkout station of claim 20 wherein the securing means are screw pin assemblies.

23. The store checkout station of claim 20 further comprising a cash register keyboard mounted on the keyboard podium of the checkout stand.

24. A checkout station as in claim 20 further comprising means for cable management.

25. The checkout station of claim 24 wherein means for cable management is located in an interior portion of the T-shaped base.

26. The checkout station of claim 25 wherein means for cable management is located in an interior portion of the keyboard stand.

27. The store checkout stand of claim 20 further comprising at least one auxiliary extension extending from the keyboard podium.

28. The store checkout stand of claim 20 wherein the keyboard podium further comprises a wire clearance hole to provide an outlet for a cable extending from a keyboard supported by the keyboard podium.

29. A three belt checkout station having a base cabinet, a counter rail, a primary belt, a product scanner, first secondary belt, a second secondary belt, a gate area including a gate between the primary belt and secondary belts; and a checkout stand comprising:

a) a T-shaped base further comprising i) a support channel beam having first and second ends;

ii) a cross beam attached to the second end of the support channel beam, said cross beam having first and second ends, said cross beam extending across the gate area of the store checkout station, the first and second ends thereof resting on the checkout station counter rail;

b) a keyboard stand mounted on said cross beam proximal to its first end; and c) a writing stand mounted on said cross beam proximal to its second end.

30. A checkout station as in claim 29 further comprising means for cable management located in an interior portion of the checkout stand.

31. A three belt checkout station having a base cabinet, a counter rail, a primary belt, a product scanner, first secondary belt, a second secondary belt, a gate area including a gate between the primary belt and secondary belts; and a checkout stand comprising:

a) a T-shaped base further comprising:

i) a support channel beam having first and second ends;

ii) a cross beam attached to the second end of the support channel beam, said cross beam having first and second ends, and first and second mounting brackets extending downwardly from the first and second ends, respectively, thereby providing a means by which the cross beam is secured to the rail of the store checkout station;

b) a keyboard stand mounted on said cross beam proximal to its first end; and c) a writing stand mounted on said cross beam proximal to its second end.

32. A keyboard stand for use at a store checkout station, the keyboard stand comprising:

a) a keyboard stand leg which extends generally vertically;

b) an angled telescopic head having i) a first arm extending generally vertically and adapted to slidably mate with the keyboard stand leg so as to allow a variable telescopic extension of the first arm and the keyboard stand leg; and ii) a second arm angularly disposed relative to the first arm and extending generally horizontally;

c) a rectilinear keyboard podium having an upper surface, a lower surface and two side edges, d) a pivot means extending from the lower surface of the keyboard podium comprising:

i) a pair of pivot flanges comprising a first pivot flange and a second pivot flange symmetrically located and extending downwardly from the keyboard podium; and ii) a podial leg extending generally horizontally and extending between the keyboard podium and the angled telescopic head, the podial leg having a first end and a second end, the first end being pivotally connected to the first and second flanges and the second end being constructed and arranged to slidably mate with the second end of the angled telescopic head so as to allow a variable telescopic extension of the second arm and the podial leg;

h) first securing means for securing the first arm of the angled telescopic head to the keyboard stand leg at a variable telescopic extension thereof and second securing means for securing the second end of the angled telescopic head to the podial leg at a variable telescopic extension thereof; and i) mounting means for mounting the keyboard stand to the checkout station.

33. The store checkout stand of claim 32 wherein:

a) the podial leg of the pivot means further comprises a podial pivot beam having a first end, a second end and a center portion, the podial pivot beam being fixed at its center portion to the first end of the podial leg and being attached to the lower surface of the keyboard podium;

b) the first and second pivot flanges are pivotally connected to the podial leg at the first and second ends, respectively, of the podial pivot beam.

34. The store checkout stand of claim 32 wherein:

a) the securing means comprises a bolt: and b) the pivot flanges further include an arcuate slot through which a screw pin is fitted, thereby providing pivoting means for the keyboard podium.

35. The store checkout stand of claim 32 wherein the securing means is a screw pin assembly located one on each sleeve of the angled telescopic head.

36. The store checkout stand of claim 32 wherein:

a) the podial leg of the pivot means further comprises a podial pivot beam having a first end, a second end and a center portion, the podial pivot beam being attached at its center portion to the first end of the podial leg and being attached to the lower surface of the keyboard podium;

b) the first and second pivot flanges are pivotally connected to the first and second ends, respectively, of the podial pivot beam.

37. The store checkout stand of claim 32 wherein the keyboard podium is made of plastic.

38. The store checkout stand of claim 32 made of metal.

39. The store checkout stand of claim 32 mounted to the cabinet base of a checkout counter.

40. The store checkout stand of claim 32 wherein the podial leg and the pivot flanges are pivotally connected at a central location under the lower surface of the keyboard podium.

41. The keyboard stand of claim 32 further comprising means for cable management in an interior portion thereof.

42. The keyboard stand of claim 32 further comprising at least one auxiliary extension extending from the keyboard podium.

43. The store checkout stand of claim 32 wherein the keyboard podium further comprises a wire clearance hole to provide an outlet for a cable extending from a keyboard supported by the keyboard podium.

* * * * *